US007389585B2

(12) United States Patent
Sato et al.

(10) Patent No.: US 7,389,585 B2
(45) Date of Patent: Jun. 24, 2008

(54) METHOD OF MANUFACTURING A LIQUID DISCHARGING HEAD

(75) Inventors: Tamaki Sato, Kanagawa (JP); Maki Hatta, Tokyo (JP); Kazuhiro Asai, Kanagawa (JP); Takumi Suzuki, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 300 days.

(21) Appl. No.: 11/285,058

(22) Filed: Nov. 23, 2005

(65) Prior Publication Data

US 2006/0125884 A1 Jun. 15, 2006

(30) Foreign Application Priority Data

Dec. 9, 2004 (JP) ..... 2004-356785

(51) Int. Cl.
*B21D 53/76* (2006.01)
*G03C 5/56* (2006.01)

(52) U.S. Cl. ..... 29/890.1; 216/27; 216/41; 216/47; 347/44; 347/54; 430/286.1; 430/320; 430/312; 430/319

(58) Field of Classification Search ..... 29/611, 29/25.35, 890.1; 216/27, 41, 47; 347/44, 347/47, 54, 56, 58; 430/286.1, 320, 312, 430/319

See application file for complete search history.

(56) References Cited

U.S. PATENT DOCUMENTS

| | | | | |
|---|---|---|---|---|
| 5,478,606 | A | 12/1995 | Ohkuma et al. | |
| 5,730,889 | A * | 3/1998 | Miyagawa et al. | 216/27 |
| 6,041,501 | A | 3/2000 | Suzuki et al. | |
| 6,155,673 | A | 12/2000 | Nakajima et al. | |
| 6,241,335 | B1 | 6/2001 | Suzuki | |
| 6,638,439 | B2 * | 10/2003 | Shimomura | 216/27 |
| 6,811,715 | B2 | 11/2004 | Suzuki | |
| 2006/0125884 | A1 | 6/2006 | Sato et al. | |
| 2006/0127813 | A1 | 6/2006 | Ohkuma et al. | |
| 2006/0277755 | A1 | 12/2006 | Kubota et al. | |
| 2007/0099121 | A1 | 5/2007 | Kubota et al. | |

FOREIGN PATENT DOCUMENTS

| | | | | |
|---|---|---|---|---|
| JP | 04312856 A | * | 11/1992 | 29/890.1 X |

* cited by examiner

*Primary Examiner*—A. Dexter Tugbang
(74) *Attorney, Agent, or Firm*—Fitzpatrick, Cella, Harper & Scinto

(57) ABSTRACT

A method for forming an ink jet recording head includes at least a step of forming an ink flow path pattern on a substrate by a photodecomposable positive type resist resin, a step of, once executing each of the steps of applying, exposing and baking thereon a nozzle-constituting resin layer which is a negative type resist containing an optical cation polymerization starting agent and having an epoxy resin as a chief component with respect to each of an ink flow path pattern and an ink discharge port pattern, collectively developing unexposed portions on the respective nozzle-constituting resin layers, and a step of removing the formed photodecomposable resin is minimized.

4 Claims, 2 Drawing Sheets

METHOD OF MANUFACTURING A LIQUID DISCHARGING HEAD

BACKGROUND OF THE INVENTION

1. Field of the Invention

This invention relates to a method of manufacturing a liquid discharging head for use in an ink jet recording process or the like, and particularly aims at an improvement in the discharging performance of a so-called side shooter type head from which liquid droplets are discharged in a direction perpendicular to a substrate on which an energy generating element is formed.

2. Related Background Art

As a liquid discharging head for discharging liquid, there is known one which, as disclosed in U.S. Pat. No. 6,155,673, discharges an ink droplet by giving heat energy to a heat generating resistance member to thereby film-boil ink, and communicating a produced bubble with the atmosphere. As a schematic manufacturing method for realizing the above-described ink jet recording head, there is known a method disclosed in U.S. Pat. No. 5,478,606.

This method has the following steps:

(1) The step of forming an ink flow path pattern with a soluble resin on a substrate on which an ink discharge pressure generating element is formed;

(2) The step of dissolving a coat resin in a solvent, and solvent-coating a soluble resin layer with this to thereby form a nozzle-constituting resin layer providing an ink flow path wall on the soluble resin layer;

(3) The step of forming an ink discharge port in the nozzle-constituting resin layer above the ink discharge pressure generating element; and (4) The step of eluting the soluble resin layer.

Now, in the above-described ink jet recording head, the shape of the ink flow path determines the discharge amount, the discharge direction and the discharge speed of an ink droplet, and it greatly affects the quality of print. Here, observing the cross-section of the ink jet recording head formed by the method disclosed in U.S. Pat. No. 5,478,606, a minute projection-shaped object is sometimes observed near the interface between the soluble resin layer and the nozzle-constituting resin layer. Further, the phenomenon that the discharge direction of the ink droplet flying from a discharge port surface is bent by this minute projection-shaped object, whereby a printed image is deteriorated, has been observed.

SUMMARY OF THE INVENTION

The present invention has been made in view of the above-noted points, and can provide a method of manufacturing a liquid discharging head capable of being improved in a discharging characteristic, and a liquid discharging head manufactured by this manufacturing method.

In order to solve the above-noted problems, the method of manufacturing a liquid discharging head according to the present invention is provided with (1) the step of laminating a positive type resist on a substrate provided with an energy generating element, and forming a first flow path pattern by the positive type resist, (2) the step of applying onto the positive type resist a first nozzle-constituting resin layer which is a negative type resist containing an optical cation polymerization starting agent and having an epoxy resin as a chief component, and forming a second flow path pattern in the first nozzle-constituting resin layer by exposure and baking, (3) the step of applying onto the first nozzle-constituting resin layer a second nozzle-constituting resin layer which is a negative type resist containing an optical cation polymerization starting agent and having an epoxy resin as a chief component, and forming a discharge port pattern in the second nozzle-constituting resin layer by exposure and baking, (4) the step of collectively developing unexposed portions on the first and second nozzle-constituting resin layers, and (5) the step of removing the first flow path pattern formed at the step (1), and is characterized in that the second flow path pattern is larger than the discharge port pattern.

Also, the liquid discharging head according to the present invention is a liquid discharging head manufactured by the above-described manufacturing method, provided with a discharge port for discharging liquid therethrough, a flow path for supplying the liquid to be discharged through the discharge port, and an energy generating element for generating energy for discharging the liquid supplied from the flow path, and is characterized in that a level difference portion providing an opening portion larger than the discharge port is provided between the flow path and the discharge port.

According to the above-described invention, a minute projection is formed at a location in the cross-section of the ink discharge port which is separate from the surface of the substrate and therefore, the deviation of the flying direction of an ink droplet due to the asymmetry of the inner shape of the ink flow path is minimized. As a result, there can be provided an ink jet recording head which is capable of effecting ink discharge free of dot-misalignment, irregularity, diminished dot printing, etc., at a high quality and stably.

DESCRIPTION OF THE PREFERRED EMBODIMENTS

A method of manufacturing a liquid discharging head according to the present invention will hereinafter be described in detail with reference to FIGS. 1A to 1G. FIGS. 1A to 1G are schematic cross-sectional views showing the method of manufacturing a liquid discharging head according to the present invention. While in the following, description is made of an ink jet recording head for ejecting ink and forming a flying liquid droplet to thereby effect recording, the present invention is not restricted to a device which effects recording. The present invention is also applicable to the manufacture of a liquid discharging head for discharging liquid, such as, for example, the preparation of electric wiring, the manufacture of a color filter and the preparation of a DNA chip.

Figure 1A:
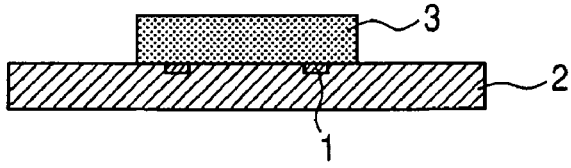
FIGS. 1A, 1B, 1C, 1D, 1E, 1F and 1G are schematic cross-sectional views showing a method of manufacturing a liquid discharging head according to the present invention.

First, as shown in FIG. 1A, an ink flow path pattern 3 is formed on a substrate 2 provided with a heat generating resistance member 1 as an energy generating element by a known method by the use of a positive type resist comprising a photodecomposable resin.

Figure 1B:
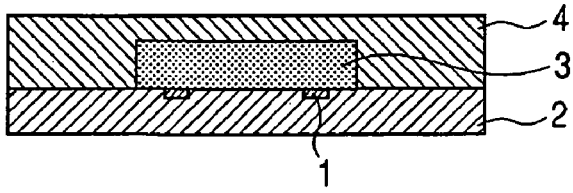

Next, as shown in FIG. 1B, a first nozzle-constituting resin layer 4 which is a negative type resist containing an optical cation polymerization starting agent and having an epoxy resin as a chief component is applied. The first nozzle-constituting resin layer 4 can be formed so as to cover the ink flow path pattern 3, and the thickness thereof can be suitably set by other factors such as a design condition.

Figure 1C:
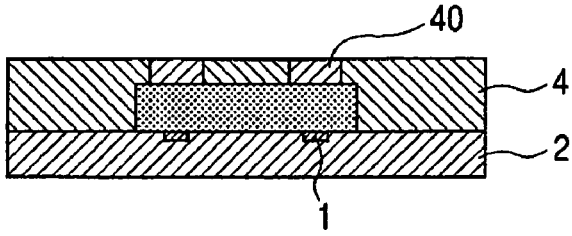

Next, the first nozzle-constituting resin layer is exposed to light of a wavelength area having photosensitivity, and baking is effected to thereby form the latent image pattern 40 of the ink flow path pattern (FIG. 1C). What is important here is that the latent image pattern 40 is made into a pattern larger than an ink discharge port which will be described later.

Figure 1D:
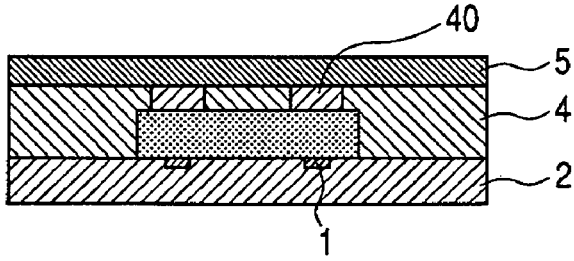

A second nozzle-constituting resin layer 5 which is a negative type resist containing an optical cation polymerization starting agent and having an epoxy resin as a chief component is further applied onto this, as shown in FIG. 1D.

Figure 1E:
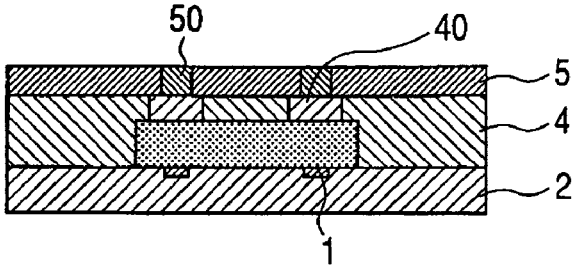

Subsequently, the second nozzle-constituting resin layer is exposed to light of a wavelength area having photosensitivity, and baking is effected to thereby form the latent image pattern 50 of the ink discharge port (FIG. 1E). Here, the wavelength area of the light applied to the second nozzle-constituting resin layer 5 differs from the wavelength area of the light applied to the first nozzle-constituting resin layer 4 in FIG. 1C, whereby it does not affect the pattern shape of the first nozzle-constituting resin layer.

Figure 1F:
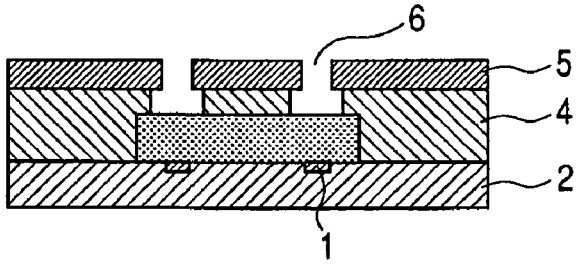
Figure 1G:
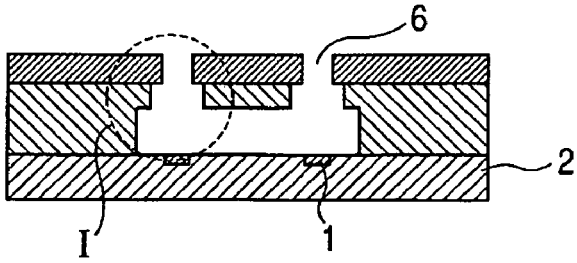

Next, as shown in FIG. 1F, the latent image pattern 40 in the first nozzle-constituting material formed at the step (3) above, and the latent image pattern 50 in the second nozzle-constituting material formed in FIG. 1E are collectively developed. Then, a portion of the ink flow path pattern is formed in an ink discharge port 6 and a portion corresponding to below it. Further, a supply port for ink supply is formed (not shown), whereafter as shown in FIG. 1G, the photodecomposable resin layer formed in FIG. 1A is eluted to thereby form an ink flow path.

Lastly, a thermosetting step is executed, whereafter electrical joint (not shown) for driving the heat generating resistance member 2, and an ink jet recording head is completed.

Figure 2:
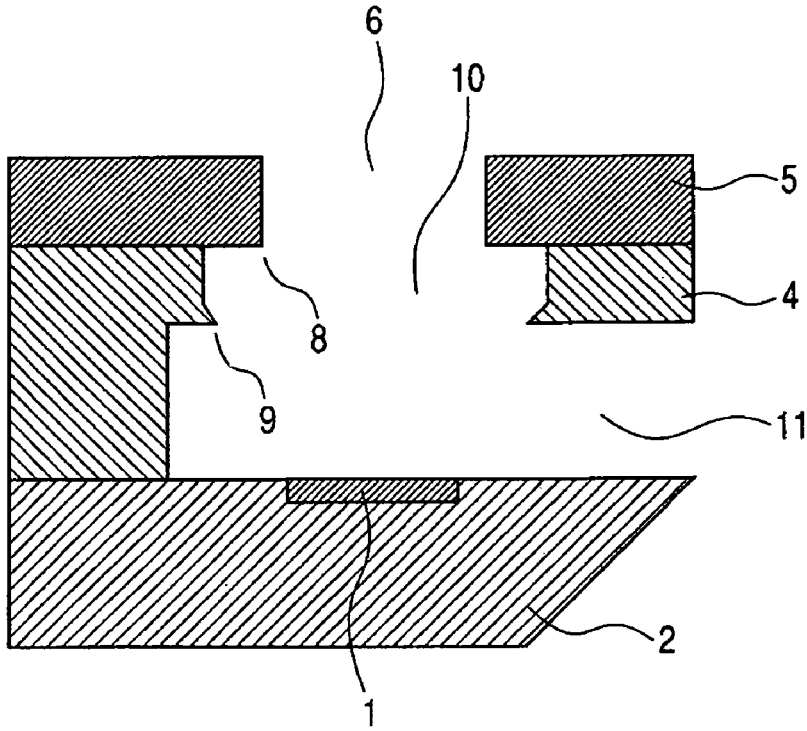
FIG. 2 is an enlarged cross-sectional view of the essential portions of the liquid discharging head of the present invention.

FIG. 2 shows a cross-sectional view of the essential portions of the liquid discharging head manufactured in this manner. FIG. 2 is an enlarged cross-sectional view of a portion (I) of FIGS. 1A to 1G. In FIG. 2, the reference numeral 1 designates the heat generating resistance member, the reference numeral 2 denotes the substrate, the reference numeral 6 designates the discharge port, and the reference numeral 11 denotes the ink flow path. In the liquid discharging head of the present invention, a level difference portion 10 providing an opening portion larger than the ink discharge port is provided between the discharge port 6 and the ink flow path 11 by the first nozzle-constituting resin layer 4 and the second nozzle-constituting resin layer 5.

In the liquid discharging head of the present invention, a minute projection 9 is not produced on the substrate surface side 8 of the cross-section of the ink discharge port, but is produced on the ink flow path side of the level difference portion 10 which is separate therefrom.

Figure 3:
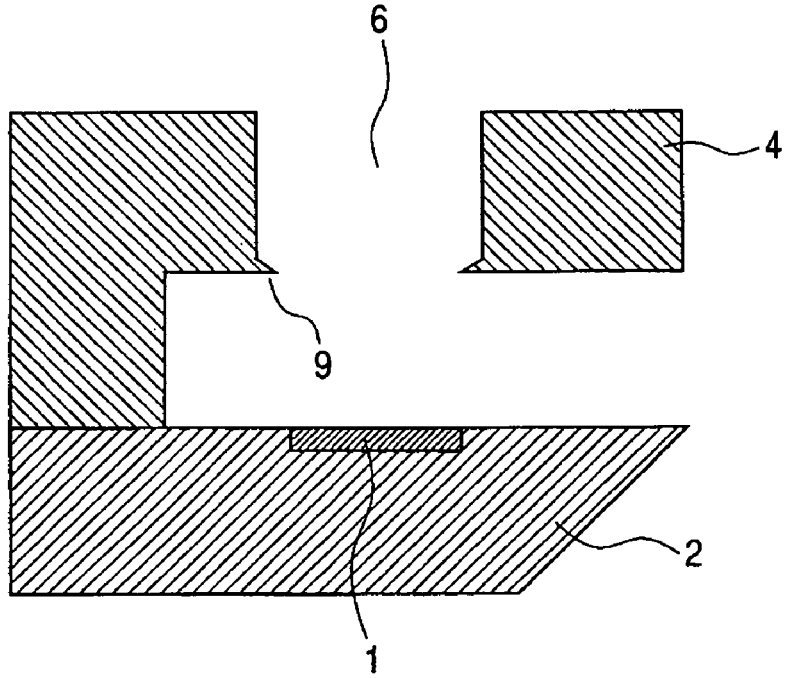
FIG. 3 is an enlarged cross-sectional view of the essential portions of a liquid discharging head manufactured by a conventional method of manufacturing a liquid discharging head.

For comparison, FIG. 3 shows a cross-sectional view of the essential portions of a liquid discharging head manufactured by a conventional method of manufacturing a liquid discharging head. In the case of the conventional liquid discharging head, a minute projection 9 is produced on the substrate surface side 8 of the cross-section of the ink discharge port.

In the present invention, as described above, the minute projection is produced at a location separate from the substrate surface side of the cross-section of the ink discharge port and therefore, the deviation of the flying direction of an ink droplet due to the asymmetry of the inner shape of the ink flow path is minimized. Also, a reduction in a refill frequency due to the hindrance of the flow during ink refilling can be minimized.

Further, three-dimensional flow path structure is formed by the nozzle-constituting resin layers and therefore, the height of the ink flow path important to the refilling characteristic of the ink, i.e., the height of the photodecomposable resin layer, can be formed with good accuracy.

Consequently, there can be provided an ink jet recording head which is capable of effecting ink discharge free of dot-misalignment, irregularity, diminished dot printing, etc. at a high quality and stably.

Embodiment 1

The present invention will hereinafter be described in greater detail with respect to some embodiments thereof.

(1) First, as shown in FIG. 1A, as a positive type resist which is a photodecomposable resin, ODUR-1010 produced by Tokyo Oka Kogyo Co., Ltd. was applied onto the substrate 1 provided with the heat generating resistance member 2 by spin coating, and was prebaked at 120° C. for 3 minutes by a hot plate. It was then exposed at 180 kj/m$^2$ by an aligner UX-3000 produced by Ushio Denki Co., Ltd., whereafter it was developed with methyl isobutyl ketone, and was rinsed with isopropyl alcohol to thereby form the ink flow path pattern 3.

(2) Next, a first negative resist consisting of the following composition was spin-coated as the first nozzle-constituting resin layer 4, and was prebaked at 90° C. for 3 minutes by a hot plate.

| | |
|---|---|
| EHPE (produced by Diecell Kagaku Kogyo Co., Ltd.) | 100 parts by weight |
| 1,4HFAB (produced by Central Glass Co., Ltd.) | 20 parts by weight |
| SP-170 (produced by Asahi Denka Kogyo Co., Ltd.) | 2 parts by weight |
| A-187 (produced by Nippon Unicar Co., Ltd.) | 5 parts by weight |
| Methyl isobutyl ketone | 100 parts by weight |
| Diglyme | 100 parts by weight |

(3) Then, as shown in FIG. 1C, exposure at 5000 J/m$^2$ was effected by the use of an aligner MPA-600 produced by Canon Inc. and light of a wavelength of 290-400 nm, and PEB was effected at 90° C. for 4 minutes to thereby form the latent image pattern 40.

(4) Subsequently, as shown in FIG. 1D, a second negative resist consisting of the following composition was spin-coated as the second nozzle-constituting resin layer 5, and was prebaked at 90° C. for 3 minutes by the hot plate.

| | |
|---|---|
| EHPE (produced by Diecell Kagaku Kogyo Co., Ltd.) | 100 parts by weight |
| 1,4HFAB (produced by Central Glass Co., Ltd.) | 20 parts by weight |
| SP-172 (produced by Asahi Denka Kogyo Co., Ltd.) | 6 parts by weight |
| A-187 (produced by Nippon Unicar Co., Ltd.) | 5 parts by weight |
| Xylene | 200 parts by weight |

(5) Subsequently, as shown in FIG. 1E, exposure at 2500 J/m$^2$ was effected by the use of an aligner FPA-3001iW produced by Canon Inc. and light of a wavelength of 365 nm, and PEB was effected at 90° C. for 4 minutes to thereby form the latent image pattern 50.

(6) Next, it was developed with mixed liquid of methyl isobutyl ketone/xylene=2/3, and was rinsed with xylene to thereby collectively form the ink discharge port 6 and a portion of the ink flow path pattern.

(7) Then, an opening pattern for ink supply was formed (not shown), whereafter exposure at 300 kJ/m$^2$ was effected on the photodecomposable resin 3 by UX-3000, and elusion was effected by imparting an ultrasonic wave to methyl lactate to thereby form the ink flow path. Lastly, electrical joint (not shown) for driving the heat generating resistance member 2 was effected to thereby complete the ink jet recording head.

Embodiment 2

In this embodiment, an ink jet recording head is manufactured by a method similar to that in Embodiment 1 above. However, an aligner FPA-3000EX6 produced by Canon Inc. is used for the exposure of the first nozzle-constituting resin layer 4 effected in item (3) in Embodiment 1 above, and exposure at 400 $J/m^2$ is effected by the use of light of a wavelength of 248 nm. As in the pattern exposure of the ink discharge port, a stepper is used for the exposure at this step, whereby it becomes possible to form a pattern of higher accuracy.

As the result of printing effected by the use of an ink jet recording head manufactured in this manner, printing of a high quality free of dot-misalignment, irregularity, diminished dot printing, etc. was possible. Consequently, ink discharge free of dot-misalignment, irregularity, diminished dot printing, etc. became possible at a high quality and stably.

This application claims priority from Japanese Patent Application No. 2004-356785 filed Dec. 9, 2004, which is hereby incorporated by reference herein.

What is claimed is:

1. A method of manufacturing a liquid discharging head, comprising:

(1) a step of laminating a positive type resist on a substrate provided with an energy generating element, and forming a first flow path pattern by the positive type resist;

(2) a step of applying onto the positive type resist, a first nozzle-constituting resin layer which is a first negative type resist containing an optical cation polymerization staffing agent and having an epoxy resin as a chief component, and forming a second flow path pattern in exposed portions of the first nozzle-constituting resin layer by exposure and baking;

(3) a step of applying onto the first nozzle-constituting resin layer, a second nozzle-constituting resin layer which is a second negative type resist containing an optical cation polymerization starting agent and having an epoxy resin as a chief component, and forming a discharge port pattern in exposed portions of the second nozzle-constituting resin layer by exposure and baking;

(4) a step of collectively developing unexposed portions on the first and second nozzle-constituting resin layers; and (5) a step of removing the first flow path pattern formed at said step of laminating the positive type resist, wherein the second flow path pattern is larger than the discharge port pattern.

2. A method according to claim 1, wherein the first and second nozzle-constituting resin layers have different photosensitive wavelength areas.

3. A method according to claim 1, wherein the first and second negative type resists forming the first and second nozzle-constituting resin layers are such that the chief component thereof is the same epoxy resin.

4. A method according to claim 1, wherein different optical cation polymerization starting agents are used as the optical cation polymerization starting agents of the first and second negative type resists forming the first and second nozzle-constituting resin layers.

* * * * *

UNITED STATES PATENT AND TRADEMARK OFFICE

CERTIFICATE OF CORRECTION

PATENT NO. : 7,389,585 B2
APPLICATION NO. : 11/285058
DATED : June 24, 2008
INVENTOR(S) : Sato et al.

It is certified that error appears in the above-identified patent and that said Letters Patent is hereby corrected as shown below:

ON THE COVER PAGE:
At Item (75), Inventors, "Tamaki Sato, Kanagawa (JP); Maki Hatta, Tokyo (JP); Kazuhiro Asai, Kanagawa (JP); Takumi Suzuki, Kanagawa (JP)" should read --Tamaki Sato, Kawasaki (JP); Maki Hatta, Tachikawa (JP); Kazuhiro Asai, Atsugi (JP); Takumi Suzuki, Yokohama (JP)--.

TITLE PAGE:
Item (56), References Cited, Foreign Patent Documents, "JP 04312856 A * 11/1992 ..... 29/890.1x" should read --JP 4-4312856 A * 11/1992 ..... 29/890.1x--.

TITLE PAGE:
Item (57), Abstract, Line 11, "resin" should read --resin.--.
Item (57), Abstract, Line 12, "is minimized." should be deleted.

COLUMN 4:
Line 57, "FPA-3001IW" should read --FPA-300iw--.

COLUMN 6:
Line 4, "staffing" should read --starting--.

Signed and Sealed this

Third Day of March, 2009

John Doll

JOHN DOLL
*Acting Director of the United States Patent and Trademark Office*